US009144297B2

(12) United States Patent
Park et al.

(10) Patent No.: US 9,144,297 B2
(45) Date of Patent: Sep. 29, 2015

(54) ROTATING TOOTHBRUSH

(75) Inventors: Jong Chan Park, Chungcheongbuk-do (KR); Man Joong Kim, Daejeon (KR); Jung Wan Woo, Daejeon (KR); Jung Tak Woo, Daejeon (KR)

(73) Assignee: HINT CO., LTD. (KR)

( * ) Notice: Subject to any disclaimer, the term of this patent is extended or adjusted under 35 U.S.C. 154(b) by 262 days.

(21) Appl. No.: 13/582,882

(22) PCT Filed: Mar. 22, 2011

(86) PCT No.: PCT/KR2011/001938

§ 371 (c)(1),
(2), (4) Date: Sep. 5, 2012

(87) PCT Pub. No.: WO2011/118950

PCT Pub. Date: Sep. 29, 2011

(65) Prior Publication Data

US 2013/0000061 A1 Jan. 3, 2013

(30) Foreign Application Priority Data

Mar. 24, 2010 (KR) ..... 10-2010-0026056
Jul. 7, 2010 (KR) ..... 10-2010-0065500
Mar. 7, 2011 (KR) ..... 10-2011-0020067

(51) Int. Cl.
*A46B 9/04* (2006.01)
*A46B 7/02* (2006.01)
*A46B 5/00* (2006.01)

(52) U.S. Cl.
CPC ..... *A46B 7/02* (2013.01); *A46B 5/0075* (2013.01); *A46B 5/0095* (2013.01); *A46B 2200/1066* (2013.01)

(58) Field of Classification Search
CPC ..... A46B 9/04; A46B 5/0075; A46B 5/0087; A46B 5/0083; A46B 2200/1066
USPC ..... 15/167.1, 172
See application file for complete search history.

(56) References Cited

U.S. PATENT DOCUMENTS 4,333,199 A * 6/1982 Del Rosario ..... 15/167.1
5,884,354 A * 3/1999 Anderson ..... 15/167.1

(Continued)

FOREIGN PATENT DOCUMENTS

CN 1161643 A 10/1997
CN 2588954 Y 12/2003

(Continued)

OTHER PUBLICATIONS

International Search Report for International Application No. PCT/KR2011/001938 mailed Nov. 23, 2011.

*Primary Examiner* — Shay Karls
(74) *Attorney, Agent, or Firm* — Brinks Gilson & Lione

(57) ABSTRACT

Disclosed herein is a rotating toothbrush including: a handle provided with a lever; a head part having bristles implanted on a lower surface thereof and a shaft vertically provided on an upper surface thereof; an operating rod provided in the handle and operated in conjunction with the lever to move linearly in a length direction of the handle; a tilting member rotatably supporting the shaft and pressed when the operating rod moves forward, thereby being tilted at a predetermined angle in an upward direction together with the head part based on a tilting axis; and a rotation driving member connected to the operating rod and the shaft to rotate the shaft when the operating rod moves forward, thereby allowing the head part to form a T shape with the handle. Therefore, the head part is tilted at a predetermined angle in the upward direction when the head part forms the T shape with the handle, such that bristles reach lower portions of lower front teeth, thereby making it possible to prevent generation of tartar as much as possible.

22 Claims, 18 Drawing Sheets

(56) References Cited

U.S. PATENT DOCUMENTS

| | | | |
|---|---|---|---|
| 6,907,636 | B2 | 6/2005 | Hafemann |
| 2008/0172812 | A1 | 7/2008 | Dean |

FOREIGN PATENT DOCUMENTS

| | | | |
|---|---|---|---|
| JP | S63-153833 | | 10/1988 |
| JP | 2006-204464 | A | 8/2006 |
| JP | 2008-522700 | A | 7/2008 |
| KR | 20-0377264 | Y1 | 3/2005 |
| KR | 20-0430276 | Y1 | 11/2006 |
| KR | 10-2008-0089802 | A | 10/2008 |
| KR | 2008-0089802 | A | 10/2008 |
| WO | WO 2006/004316 | A1 | 1/2006 |

* cited by examiner

ROTATING TOOTHBRUSH

This application is a National Stage of International Application PCT/KR2011/001938 filed Mar. 22, 2011, which claims the benefit of the filing date under 35 U.S.C. §119(a) of Korean Patent Application Serial Nos. KR 10-2011-0020067, filed Mar. 7, 2011, KR 10-2010-0065500 filed Jul. 7, 2010, and KR 10-2010-0026056, filed Mar. 24, 2010. The entirety of all applications is hereby incorporated by reference.

TECHNICAL FIELD

The present invention relates to a rotating toothbrush, and more particularly, to a rotating toothbrush capable of freely brushing teeth in a vertical or horizontal direction and allowing bristles to reach lower front teeth.

BACKGROUND ART

In a generally used toothbrush, a handle and a head part provided with bristles are formed in a linear shape.

However, when teeth are brushed using a linear toothbrush, teeth are brushed in a horizontal direction, such that foreign materials caught between the teeth are not completely removed and enamel is easily damaged, thereby causing a dental disease.

In order to prevent these problems, it has been recommended to brush the teeth from the gums to the ends of the teeth in a scheme similar to combing. However, since it is structurally difficult for the linear toothbrush to move in the vertical direction, the teeth is habitually brushed in the horizontal direction, such that damage of the enamel may not be basically prevented.

Meanwhile, even though the teeth are brushed in the vertical direction using the linear toothbrush, much movement of the wrist joint is generated, such that the wrist joint is easily damaged.

Therefore, Korean Utility Model No. 0266621 has disclosed a T shaped toothbrush so that teeth may be brushed in the vertical direction.

In the case of the T shaped toothbrush according to the related art, tooth-brushing in the vertical direction (brushing of front teeth, canine teeth, and the like) is easily performed; however, tooth-brushing in the horizontal direction (brushing of back teeth, and the like) is not easily performed.

Further, in general, the lower front teeth have a structure in which they protrude in an upward direction. However, in the case of the T shaped toothbrush according to the related art, as shown in FIG. 1, bristles 121*a* are arranged to be in parallel with the teeth, such that bristles 121*a* do not reach lower portions of the lower front teeth T'.

In this case, when a handle 110 is drawn in a direction toward a jaw in order to brush the lower portions of the lower front teeth T', the handle 110 is locked to the jaw, such that the bristles 121*a* do not reach lower portions of the lower front teeth T'.

Therefore, a large amount of tartar is generated particular at the lower portion of the lower front teeth T', such that the number of uses of dental floss increases, thereby causing an increase in a time required for brushing teeth.

DISCLOSURE

Technical Problem

Accordingly, the present invention has been made to solve the above-mentioned problems occurring in the prior art while advantages achieved by the prior art are maintained intact.

One subject to be achieved by the present invention is to provide a rotating toothbrush capable of freely brushing teeth in a vertical or horizontal direction and allowing bristles to reach lower front teeth.

Technical Solution

In one aspect of the present invention, there is provided a rotating toothbrush including: a handle provided with a lever; a head part having bristles implanted on a lower surface thereof and a shaft vertically provided on an upper surface thereof; an operating rod provided in the handle and operated in conjunction with the lever to move linearly in a length direction of the handle; a tilting member rotatably supporting the shaft and pressed when the operating rod moves forward, thereby being tilted at a predetermined angle in an upward direction together with the head part based on a tilting axis; and a rotation driving member connected to the operating rod and the shaft to rotate the shaft when the operating rod moves forward, thereby allowing the head part to form a T shape with the handle.

The rotation driving member may have one end fixed to a lower surface of the operating rod and the other end inserted into the shaft so as to be eccentric from the center of the shaft.

The operating rod may include: a rod body connected integrally with the lever; a rod head coupled integrally with a front end of the rod body and including tilting guide grooves formed at both sides thereof; and a holder having one end connected to the rod head and the other end which is a free end to fix one end of the rotation driving member, wherein the holder is pressed by a pressing protrusion formed at the handle when the operating rod moves forward, thereby being pressed in a downward direction.

The handle may include a handle body provided with the lever and a handle head having one side assembled integrally with the handle body and the other side assembled to the tilting member through the tilting axis and having a discharge hole formed in an upper surface thereof, wherein the handle head has the pressing protrusion formed at a lower surface thereof.

The holder may be cut and formed at the rod head.

The holder may be installed at a cut part cut and formed in the rod head and have one end rotatably supported in the cut part through a holder axis.

The tilting member may include: a tilting axis support part supporting the tilting axis; and a shaft inserting part formed integrally with the tilting axis support part, having the shaft inserted thereinto, and having the tilting guide protrusions formed at both sides thereof.

The shaft may be supported by a support pin in the shaft inserting part, and the shaft may have a support pin guide surface formed in a rotation direction so that it does not interfere with the support pin when it is rotated.

The shaft may be provided with a first stopper part to which the support pin is locked when the head part forms a linear shape with the handle and a second stopper part to which the support pin is locked when the head part forms the T shape with the handle, wherein the first stopper part and the second stopper part are formed to be stepped with respect to the support pin guide surface.

The rotating toothbrush may further include a stopper member fixed integrally with an upper surface of the shaft to prevent the shaft from being rotated by a predetermined angle or more with respect to the tilting member.

The stopper member may include: a stopper body; a first stopper part protruded and formed on an outer peripheral surface of the stopper body and locked to a first locking groove formed at the shaft inserting part when the head part forms a linear shape with the handle; and a second stopper part protruded and formed at a position spaced apart from the first stopper part on the outer peripheral surface of the stopper body and locked to a second locking protrusion formed at the shaft inserting part when the head part form the T shape with the handle.

The rotation driving member may include: a rotation guide body provided in the tilting member so as to be connected to the operating rod and provided with a rotation guide protrusion; and a rotating body provided in the tilting member and having an inclined cam formed in an outer peripheral surface thereof and guided along the rotation guide protrusion to thereby be rotated when the tilting member is tilted, thereby rotating the shaft.

The tilting member may include: a tilting body supporting the tilting axis and having tilting inclined surfaces formed at both sides thereof, the tilting inclined surfaces being pressed by the operating rod when the operating rod moves forward, thereby allowing the tilting member to be tilted; and a receiving body having tilting guide protrusions formed at both sides thereof and receiving the rotation driving member therein, wherein the tilting guide protrusions are guided along tilting guide grooves formed in the operating rod.

The rotation guide body may include support protrusions formed at both sides thereof so as to be protruded toward the operating rod, and the operating rod may be provided with slots for guiding the support protrusions when it moves in a front and rear direction.

The operating rod may include: a rod body connected integrally with the lever; and a rod head coupled integrally with a front end of the rod body and including the tilting guide grooves and the slots penetratedly formed at both sides thereof, respectively, and enclosing the receiving body.

The operating rod may have a sleeve fitted into a rear end thereof, wherein the sleeve has a coupling pin formed to be protruded therefrom and fitted into a coupling hole formed in the lever.

The handle may further include a ball and a spring installed at an inner portion thereof, wherein the ball contacts an outer peripheral surface of the operating rod and the spring elastically presses the ball toward the operating rod.

The operating rod may include first and second seating grooves formed in an outer peripheral surface thereof so as to be spaced apart from each other and seat the ball, such that when the head part forms the linear shape with the handle, the ball is positioned at the first seat groove, and when the operating rod moves forward to allow the head part to form the T shape with the handle, the ball is positioned at the second seating groove.

A rear end of the operating rod may be provided with a clip having an elastic piece to which the rear end of the operating rod is elastically coupled and a clip body formed integrally with the elastic piece and having a coupling pin protruded therefrom, wherein the coupling pin is fitted into a coupling hole formed in the lever.

The clip may include first and second seating grooves formed in an upper surface thereof so as to be spaced apart from each other and seat a movement preventing protrusion formed at an inner surface of the handle, such that when the head part forms the linear shape with the handle, the movement preventing protrusion is positioned at the first seat groove, and when the operating rod moves forward to allow the head part to form the T shape with the handle, the movement preventing protrusion is positioned at the second seating groove.

The handle may include: a handle body provided with the lever; and a handle head having one side assembled integrally with the handle body and the other side assembled to the tilting member through the tilting axis and having a discharge hole formed in an upper surface thereof.

The head part may be tilted at an angle of 5 to 40 degrees in the upward direction with respect to the handle based on the tilting axis.

The head part may be rotated by an angle of 0 to 90 degrees with respect to the handle based on the shaft.

The lever may be rotated in a front and rear direction based on the lever axis installed at an inner portion of the handle.

Advantageous Effects

As set forth above, with the rotating toothbrush according to the exemplary embodiment of the present invention, the head part is tilted at a predetermined angle in the upward direction when the head part forms the T shape with the handle, such that the bristles reach the lower portions of the lower front teeth, thereby making it possible to prevent generation of tartar as much as possible.

In addition, since the rotating toothbrush has a structure in which rotation states of the head part and the handle are freely adjusted (that is, a structure in which the head part forms the linear shape or the T shape with the handle), it is rotated so that the head part forms the linear shape with the handle when back teeth are brushed and forms the T shape with the handle when front teeth or canine teeth are brushed, such that it may be conveniently used.

BEST MODE

Figure 1:
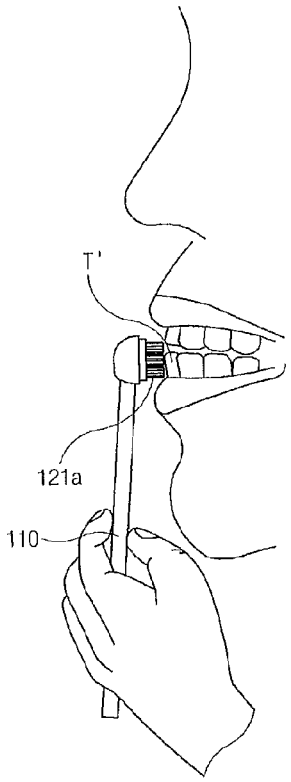
FIG. 1 is a view describing a problem of the T shaped toothbrush according to the related art.
Figure 2:
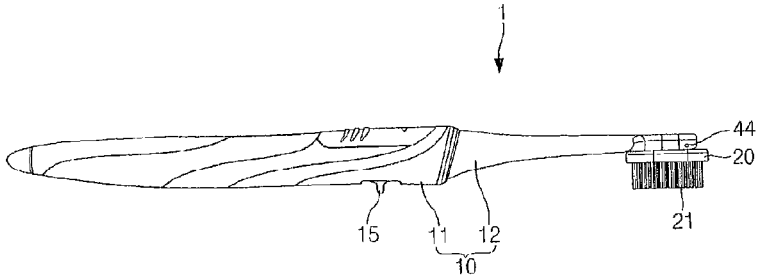
FIG. 2 is a side view showing an initial state in which a head part and a handle of a rotating toothbrush according to a first exemplary embodiment of the present invention form a linear shape with each other.
Figure 3:
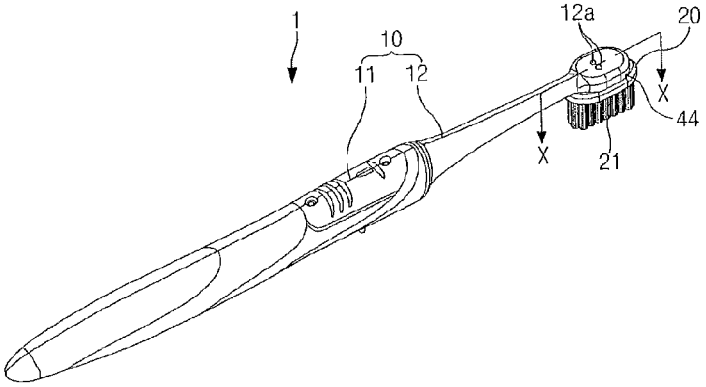
FIG. 3 is a perspective view of FIG. 2 when viewed from the top.

Hereinafter, the present invention will be described in detail with reference to the accompanying drawings.

Prior to describing the present invention, in several exemplary embodiments, components having the same configuration will be described representatively in a first exemplary embodiment by the same reference numerals. In exemplary embodiments other than the first exemplary embodiment, only configurations different from those of the first exemplary embodiment will be described.

First Exemplary Embodiment

A rotating toothbrush according to a first exemplary embodiment of the present invention has a structure in which a head part forms a T shape with a handle simultaneously with being tilted at a predetermined angle (θ) in an upward direction to allow bristles to reach lower portions of lower front teeth.

To this end, as shown in FIGS. 2 to 6, the rotating toothbrush 1 according to the first exemplary embodiment of the present invention is mainly configured to include a handle 10 provided with a lever 15, a head part 20 having bristles 21 implanted on a lower surface thereof and a shaft 22 vertically provided on an upper surface thereof, a tilting member 40 tilted in an upward direction based on a tilting axis 44 by an operating rod 30 operated in conjunction with the lever 15, and a rotation driving member 50 rotating the shaft 22 when the operating rod 30 moves forward, thereby allowing the head part 20 to form a T shape with the handle 10.

In the handle 10, which is to be grasped by a user, a handle body 11 and a handle head 12 are detachably assemble to each other. To this end, an inner side of a rear end of the handle head 12 is provided with a hook 12*c* protruded toward the handle body 11 and hooked to an inner side of the handle body 11. Here, the handle body 11 and the handle head 12 are assembled to each other in a hook scheme. However, the handle body 11 and the handle head 12 may also be manufactured so as to be assembled to each other in a screw scheme.

The handle body 11 is provided with the lever 15 so as to be rotatable in a front and rear direction based on a lever axis 18 and includes a rod guide part 11*b* protruded and formed at a front end thereof so as to guide the operating rod 30 inserted thereinto.

The lever 15 includes a lever body 16 exposed outwardly of the handle body 11 and an axis connection piece 17 extended from the lever body 16 and connected to the lever axis 18.

Here, an inner portion the handle body 11 is provided with a fixing bracket 19 and a ball 60 and a spring 65, wherein the fixing bracket 19 is fixed to the inner portion of the handle body 11 and connected to the axis connection piece 17 by the lever axis 18, and the ball 60 and the spring 65 elastically support the operating rod 30 against the handle body 11.

The ball 60 contacts an outer peripheral surface of the operating rod 30, and the spring 65 serves to support the ball 60 so as to be elastically pressed toward the operating rod 30. That is, the ball 60 applies a predetermined force to the operating rod 30 by elastic force of the spring 65, thereby making it possible to prevent movement of the operating rod 30 when the operating rod 30 moves linearly in the handle 10.

The handle head 12 has a shape in which it encloses a rod head 32 to be described below and includes a pressing protrusion 12*b* protruded and formed at a lower surface thereof, wherein the pressing protrusion 12*b* presses a holder 37 of an operating rod 30 to be described below.

Here, a front end of the handle head 12 is coupled to the tilting member 40 by the tilting axis 44, such that the tilting member 40 may be tilted in an upward or downward direction with respect to the handle head 12 based on the tilting axis 44. In addition, the handle head 12 may include a discharge hole 12*a* penetratedly formed in an upper surface thereof in order to discharge foreign materials such as water, or the like, entering the handle 10.

The shaft 22 is formed vertically to the upper surface of the head part 20 and inserted into a shaft inserting part 42 of a tilting member to be described below. Here, the shaft 22 is supported by a support pin 25 (See FIG. 8) coupled to the shaft inserting part 42 and the shaft 22 in a state in which it is inserted into the shaft inserting part 42.

Here, the shaft 22 may also include a bush (not shown) integrally fitted into a circumference thereof so that the shaft 22 is smoothly rotated when the shaft 22 is rotated in the shaft inserting part 42.

Figure 8:
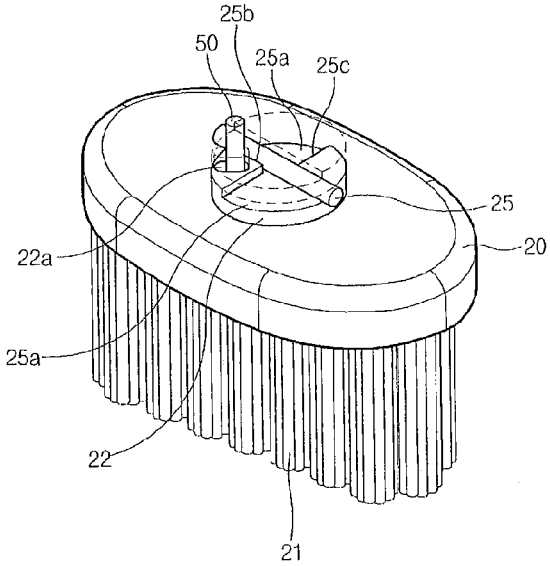
FIG. 8 is a view describing a principle in which a shaft of FIG. 6 is supported in a shaft inserting part.

The shaft 22 needs to have a support pin guide surface 25*a* formed in a rotation direction so that it does not interfere with the support pin 25 when it is rotated, as shown in FIG. 8.

Further, the shaft 22 is provided with a first stopper part 25*b* to which the support pin 25 is locked when the head part 20 forms the linear shape with the handle 10 and a second stopper part 25*c* to which the support pin 25 is locked when the head part 20 forms the T shape with the handle 10, wherein the first stopper part 25*b* and the second stopper part 25*c* are formed to be stepped with respect to the support pin guide surface 25*a*. Here, each of the first and second stopper part 25*b* and 25*c* may be formed at a rotation position of 0 to 90 degrees so that the head part 20 is rotated by an angle of 0 to 90 degrees with respect to the handle 10.

Meanwhile, the shaft 22 is provided with an inserting hole 22*a* into which the other end of the rotation driving member 50 is inserted, at a position that is eccentric from the center thereof.

The operating rod 30 is provided in the handle 10 and operated in conjunction with the lever 15 to move in a length direction of the handle 10. The operating rod 30 includes a rod body 31 connected to the lever 15 to as to be operable in conjunction with the lever 15, a rod head 32 coupled integrally with a front end of the rod body 31 and including tilting guide grooves 35 formed at both sides thereof in order to guide tilting guide protrusions 43, and a holder 37 having one end connected to the rod head 32 and the other end which is a free end.

The rod body 31 has a sleeve 33 fitted into a rear end thereof, wherein the sleeve 33 is provided with a coupling pin 34 and the coupling pin 34 is fitted into a coupling hole 17*a* formed in the axis connection piece 17. Therefore, when the lever 15 moves in the front and rear direction based on the lever axis 18, the sleeve 33 and the operating rod 30 may move linearly in the front and rear direction.

Figure 5:
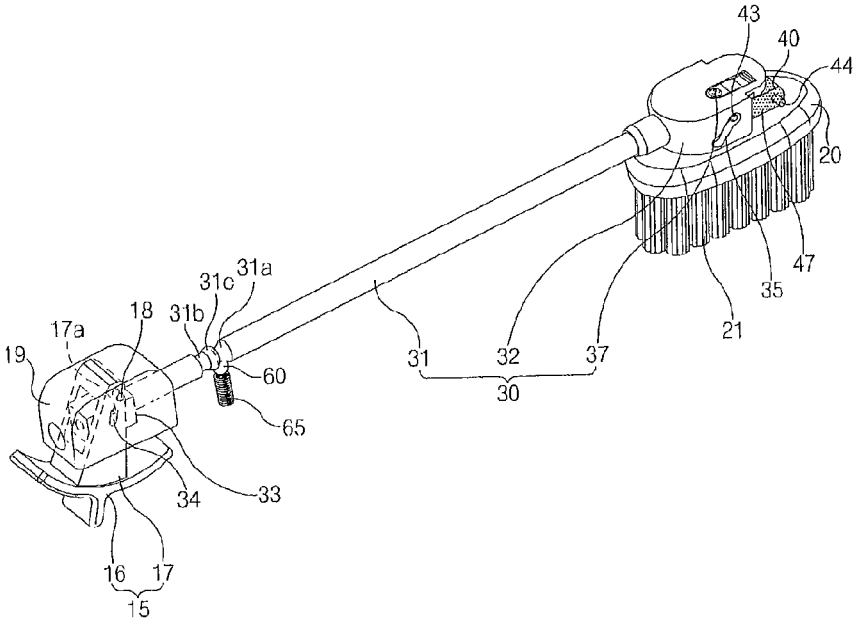
FIG. 5 is a perspective view showing a state in which a handle is removed in FIG. 3.
Figure 6:
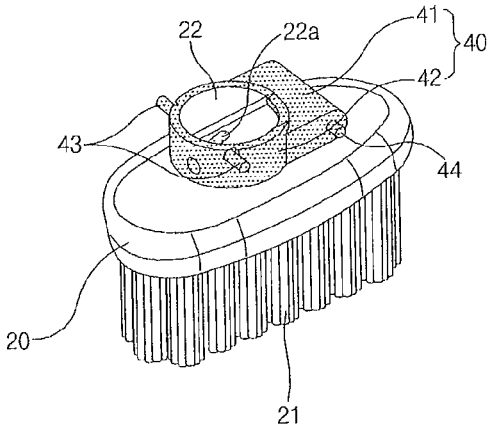
FIG. 6 is a perspective view showing a state in which an operating rod is removed in FIG. 5.
Figure 7:
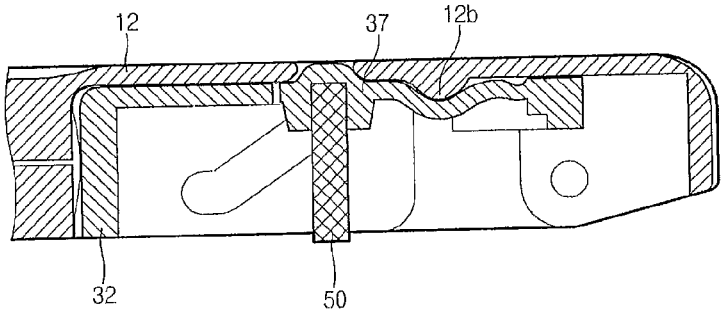
FIG. 7 is a cross-sectional view taken along the line X-X of FIG. 3.
Figure 9:
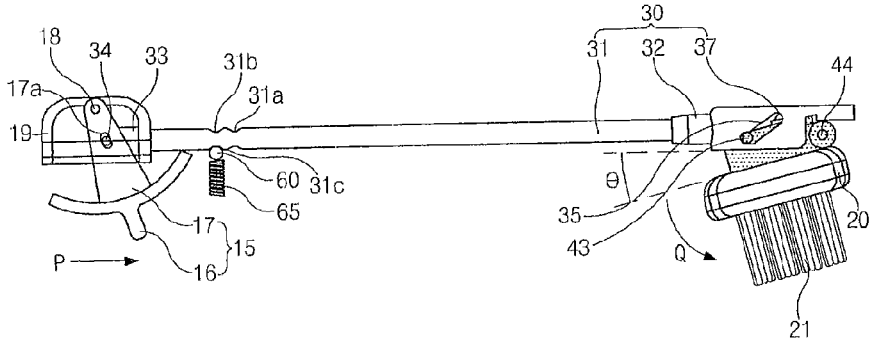
FIG. 9 is a side view showing a state in which a head part is rotated an angle of 90 degrees while being tilted in an upward direction in the case in which a lever moves forward in the state of FIG. 5.

Meanwhile, the rod body 31 includes first and second seating grooves 31*a* and 31*b* depressed at a depth smaller than an outer diameter of the rod body 31 in an outer peripheral surface thereof so as to seat the ball 60. In this case, the first and second seating grooves 31*a* and 31*b* are formed at two positions, respectively, having a contact protrusion 31*c* therebetween. Therefore, when the lever 15 is positioned at an initial position as shown in FIG. 5, the ball 60 is seated in the front first seating groove 31*a*. Then, when the user moves the lever 15 forward as shown in FIG. 9, the ball 60 is pushed toward the spring 65 by the contact protrusion 31*c* (in this case, the spring 65 is compressed). Thereafter, when the contact protrusion 31*c* passes through the ball 60, the ball 60 is seated in the rear second seating groove 31*b* while the spring 65 is restored.

Figure 10:
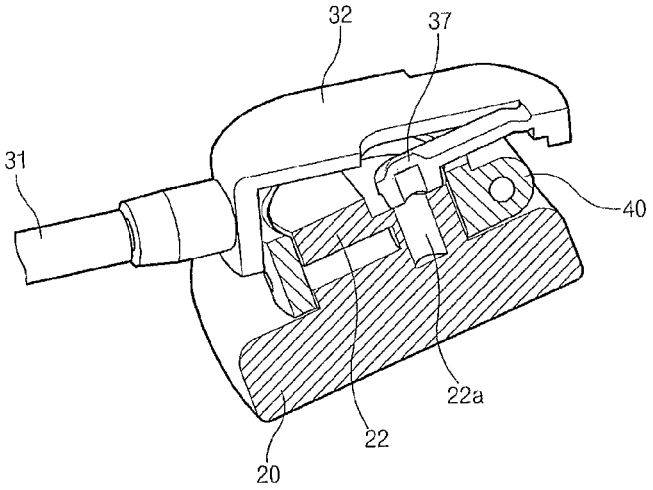
FIG. 10 is a cross-sectional view of a rod head, a tilting member, and a head part in the state of FIG. 9.
Figure 11:
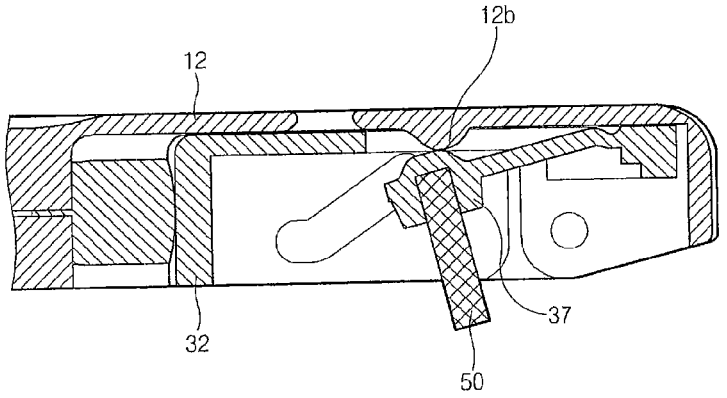
FIG. 11 is a cross-sectional view describing a principle in which a holder is pressed in FIG. 9.

The holder 37 is cut and formed in the rod head 32 and has one end attached to the rod head 32 and the other end which is a free end. Therefore, when the operating rod 30 moves forward, the holder 37 is pressed in the downward direction by the pressing protrusion 12*b* formed at the handle head 12, as shown in FIGS. 10 and 11. At the time, one end of the rotation driving member 50 is fitted into a lower surface of the other end of the holder 37.

The tilting member 40 is tilted at a predetermined angle θ (See FIG. 9) in the upward or downward direction based on the tilting axis 44, thereby allowing the head part 20 to be tilted in the upward or downward direction based on the tilting axis 44. Here, the tilting angle θ is approximately 5 to 40 degrees, more preferably, 15 degrees.

Here, the tilting member 40 includes a tilting axis support part 41 supporting the tilting axis 44 inserted thereinto and the shaft inserting part 42 formed integrally with the tilting axis support part 41 and having the shaft 22 inserted thereinto.

The shaft inserting part 42 includes tilting guide protrusions 43 protruded and formed at both sides thereof, wherein the tilting guide protrusions 43 are guided along the tilting guide grooves 35 formed at the rod head 32. Therefore, when the operating rod 30 moves forward, the tilting guide protrusions 43 move along the tilting guide grooves 35, such that the tilting member 40 may be tilted at a predetermined angle θ in the upward direction based on the tilting axis 44.

Figure 12:
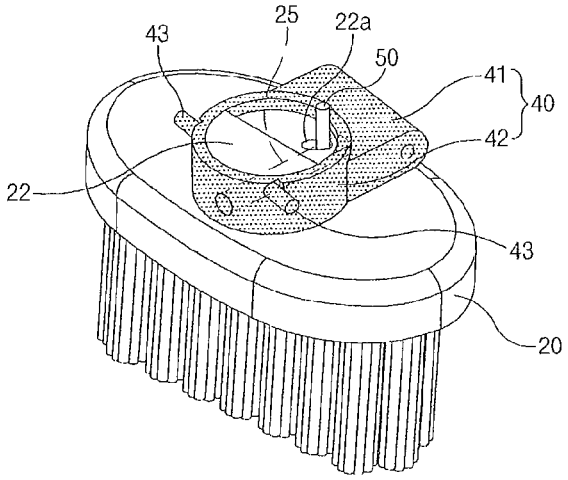
FIG. 12 is a perspective view showing a state in which the shaft is rotated by an angle of 90 degrees by a rotation driving member in the case in which the lever moves forward.

The rotation driving member 50 is coupled to the holder 37 and the shaft 22 to rotate the shaft 22 by an angle of about 90 degrees when the operating rod 30 moves forward, such that the head part 20 forms the T shape with the handle 10, as shown in FIG. 12.

A principle in which the shaft 22 is rotated by the rotation driving member 50 as described above is that the rotation driving member 50 is fitted into the inserting hole 22*a* positioned at the position that is eccentric from the center of the shaft 22, such that linear movement of the operating rod 30 may be converted into rotational movement of the shaft 22.

Through the above-mentioned configuration, a principle in which the rotating toothbrush 1 according to the exemplary embodiment of the present invention is tilted and rotated will be briefly described with reference to FIGS. 2 to 12.

First, in an initial state, the head part 20 forms the linear shape with the handle 10 as shown in FIGS. 2 to 8.

Then, when the user moves the lever 15 in a P direction (See FIG. 9), the operating rod 30 connected to the lever 15 also moves linearly in the P direction. In this case, the tilting guide protrusion 43 of the tilting member 40 is guided along the tilting guide groove 35 of the rod head 32 to thereby be tilted in the upward direction. At the same time, the rotation driving member 50 moves in the P direction to rotate the shaft 22 by an angle of 90 degrees in a Q direction (See FIG. 9), such that the head part 20 forms the T shape with the handle 10, as shown in FIG. 12. When the operating rod 30 moves linearly in the P direction, the holder 37 is pressed by the pressing protrusion 12*b* formed at the handle head 12, such that the rotation driving member 50 pushes and rotates the shaft 22 in a state in which it descends in the downward direction, corresponding to the tilting of the tilting member 40 (See FIGS. 10 and 11).

Meanwhile, in order to restore this state to the initial state in which the head part 20 forms the linear shape with the handle 10, when the user moves the lever 15 in a direction opposite to the P direction, the operating rod 30 connected to the lever 15 also moves linearly in the direction opposite to the P direction. In this case, the tilting guide protrusion 43 of the tilting member 40 is guided along the tilting guide groove 35 of the rod head 32 to thereby be tilted in the downward direction. At the same time, the rotation driving member 50 moves in the direction opposite to the P direction to rotate the shaft 22 by an angle of 90 degrees in a direction opposite to the Q direction, such that the head part 20 forms the linear shape with the handle 10. When the operating rod 30 moves linearly in the direction opposite to the P direction, the holder 37 is separated from the pressing protrusion 12*b* formed at the handle head 12 to thereby be restored to its original position, such that the rotation driving member 50 pushes and rotates the shaft 22 in a state in which it ascends in the upward direction, corresponding to the tilting of the tilting member 40 in the downward direction.

Figure 13:
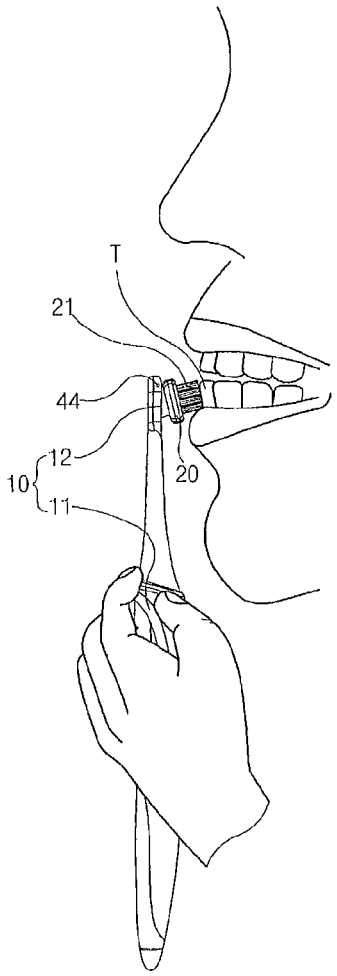
FIG. 13 is a side view schematically showing an aspect in which bristles reach lower portions of lower front teeth in the case in which teeth is brushed in the state of FIG. 9.
Figure 14:
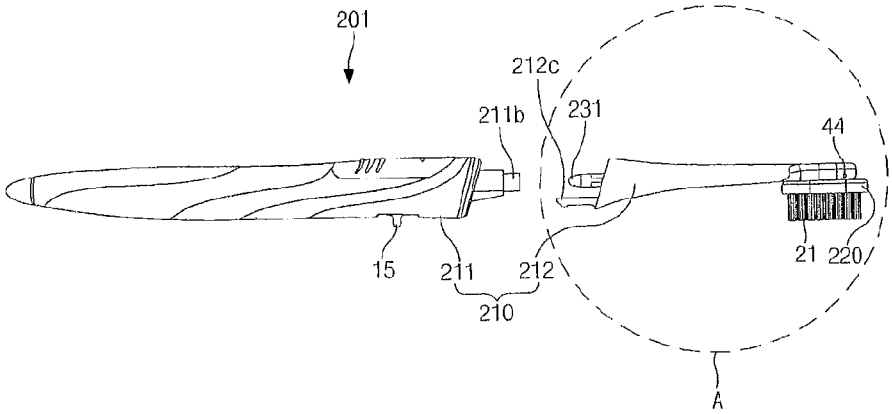
FIG. 14 is an exploded perspective view showing a state in which a handle body and a handle head are separated from each other in a rotating toothbrush according to a second exemplary embodiment of the present invention.
Figure 15:
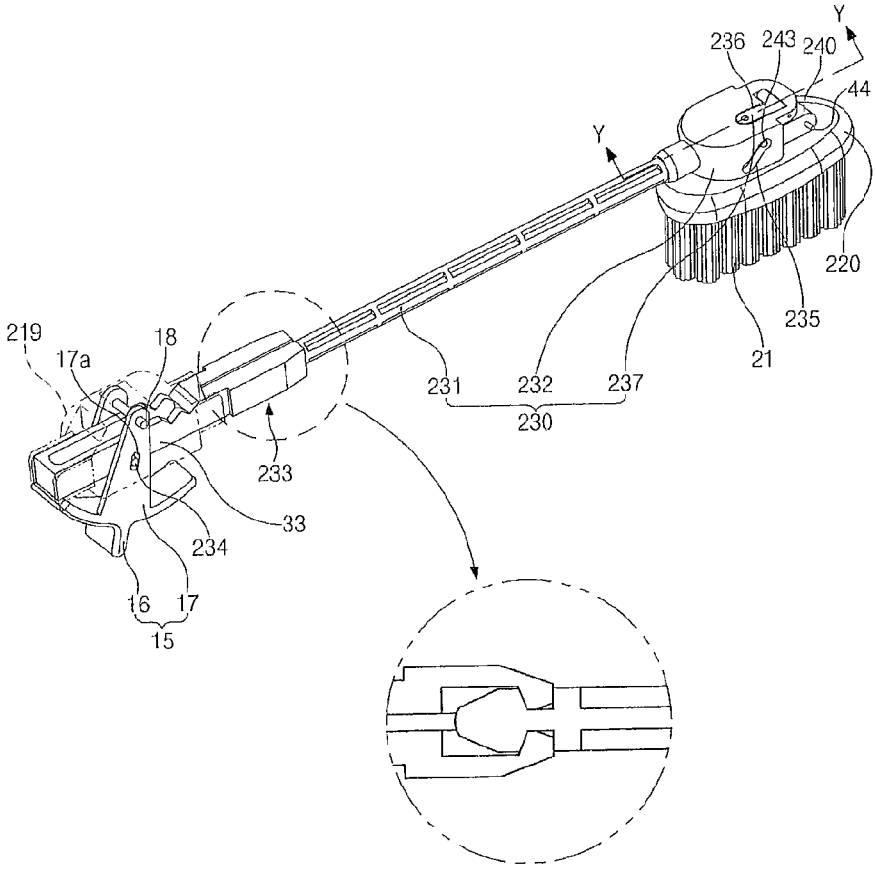
FIG. 15 is a perspective view showing a state in which a handle is removed in FIG. 14.
Figure 16:
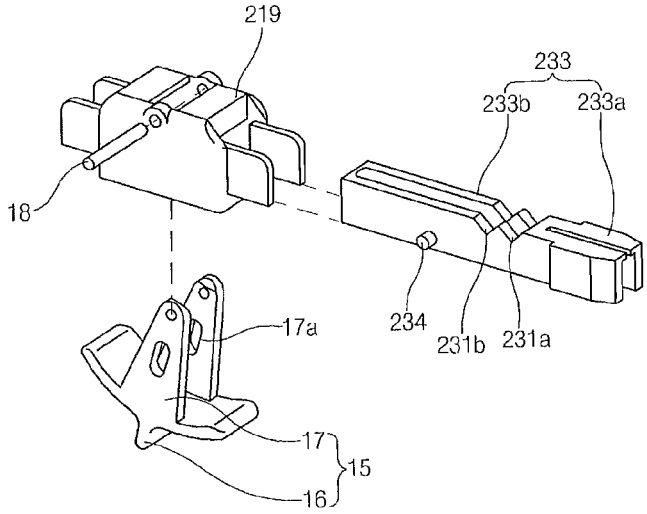
FIG. 16 is an exploded perspective view of a lever, a fixing bracket, and a clip of FIG. 15.
Figure 17:
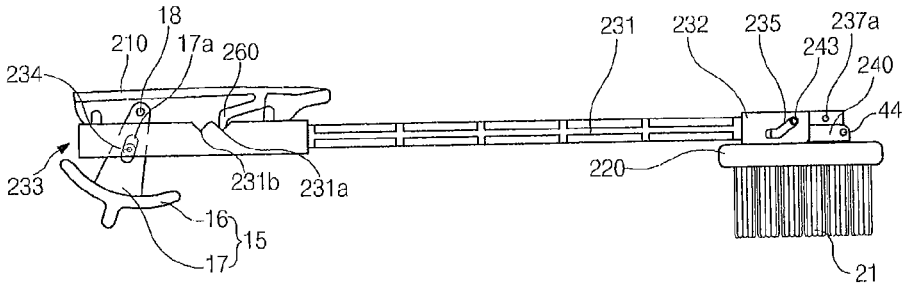
FIG. 17 is a side view showing a state in which a movement preventing protrusion formed at the handle is seated in a seating groove in FIG. 15.
Figure 18:
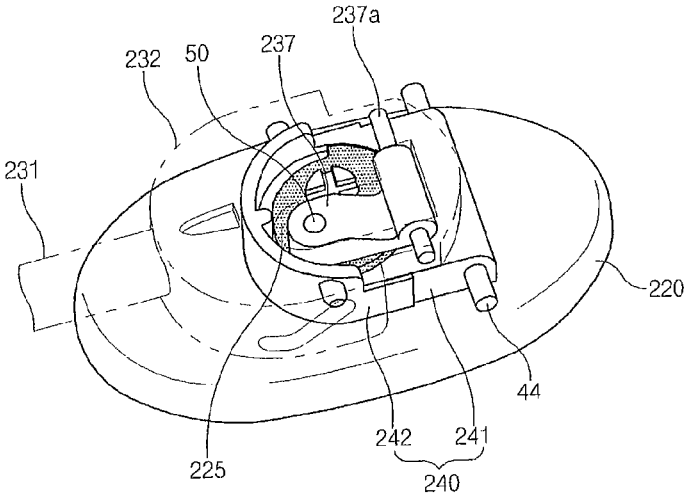
FIG. 18 is an enlarged perspective view showing a state in which the handle head in the part A of FIG. 14 is removed.
Figure 19:
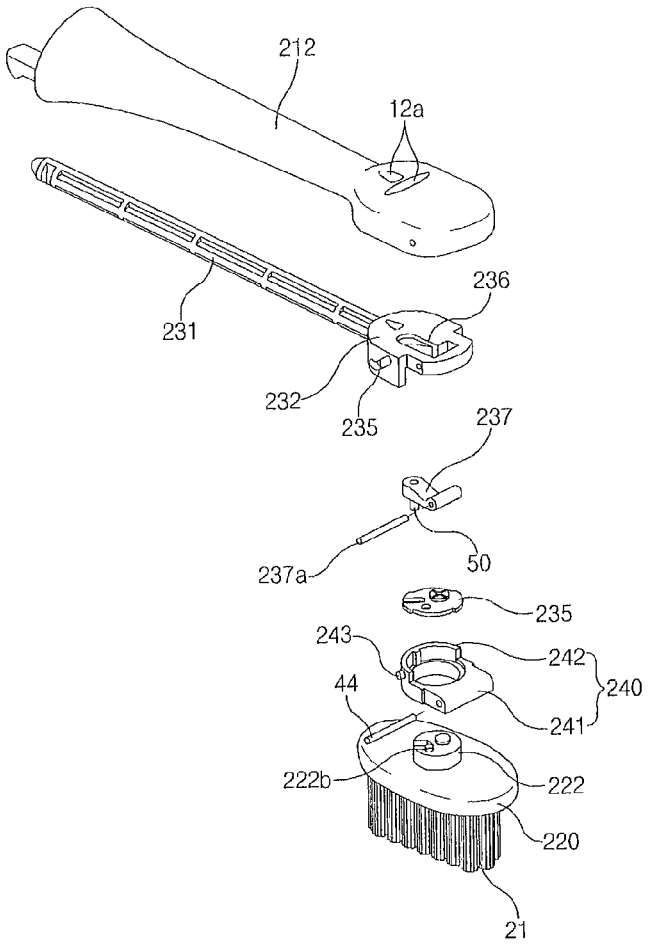
FIG. 19 is an exploded perspective view of the part A of FIG. 14.

With the rotating toothbrush 1 according to the first exemplary embodiment of the present invention having the above-mentioned configuration, when the lever 15 moves forward, since the head part 20 is tilted at a predetermined angle θ in the upward direction and at the same time, forms the T shape with the handle 10, the bristles 21 may reach the lower portions of the lower front teeth T, as shown in FIG. 13. Therefore, generation of tartar is prevented as much as possible, thereby making it possible to reduce a time required for brushing teeth.

In addition, since the rotating toothbrush 1 has a structure in which rotation states of the head part 20 and the handle 10 may be freely adjusted by moving the lever 15 forward or backward (that is, a structure in which the head part 20 may form the linear shape or the T shape with the handle 10), it is rotated so that the head part 20 forms the linear shape with the handle 10 when back teeth are brushed and forms the T shape with the handle 10 when front teeth or canine teeth are brushed, such that it may be conveniently used.

Second Exemplary Embodiment

A rotating toothbrush according to a second exemplary embodiment of the present invention has a structure in which a head part forms a T shape with a handle simultaneously with being tilted at a predetermined angle (θ) in an upward direction to allow bristles to reach lower portions of lower front teeth, similar to the rotating toothbrush according to the first exemplary embodiment of the present invention.

The rotating toothbrush 201 according to the second exemplary embodiment of the present invention is mainly configured to include a handle 210 provided with a lever 15, a head part 220 having bristles 21 implanted on a lower surface thereof and a shaft 222 vertically provided on an upper surface thereof, a tilting member 240 tilted in an upward direction based on a tilting axis 44 by an operating rod 230 operated in conjunction with the lever 15, a rotation driving member 50 rotating the shaft 222 when the operating rod 230 moves forward, thereby allowing the head part 220 to form a T shape with the handle 210, and a stopper member 225 fixed integrally with an upper surface of the shaft 222 to prevent the shaft 222 from being rotated by a predetermined angle or more, as shown in FIGS. 14 to 19.

In the handle 210, which is to be grasped by a user, a handle body 211 and a handle head 212 are detachably assemble to each other. To this end, an inner side of a rear end of the handle head 212 is provided with a hook 212*c* protruded toward the handle body 211 and hooked to an inner side of the handle body 211. Here, the handle body 211 and the handle head 212 are assembled to each other in a hook scheme. However, the handle body 211 and the handle head 212 may also be manufactured so as to be assembled to each other in a screw scheme.

The handle body 211 includes a rod inserting part 211*b* protruded and formed at a front end thereof so that a rear end of a rod body 231 of an operating rod 230 to be described below is inserted.

In addition, the handle body 211 includes the lever 15 installed so as to be rotatable in a front and rear direction based on a lever axis 18.

The lever 15 includes a lever body 16 exposed outwardly of the handle body 211 and an axis connection piece 17 extended from the lever body 16 and connected to the lever axis 18.

Here, an inner portion the handle body 211 is provided with a fixing bracket 219 and a clip 223, wherein the fixing bracket 219 is fixed to the inner portion of the handle body 211 and connected to the axis connection piece 17 by the lever axis 18, and the clip 233 fitted into a rear end of the operating rod 230 and operated in conjunction with the lever 15 to move the operating rod 230 linearly in the front and rear direction.

That is, the rotating toothbrush 201 according to the second exemplary embodiment of the present invention is different from the rotating toothbrush 1 according to the first exemplary embodiment of the present invention in which the clip 233 including an elastic piece 233*a* and a clip body 233*b* is used instead of the sleeve 33.

The clip 233 include the elastic piece 233*a* to which a rear end of a rod body 231 of an operating rod 230 to be described below is elastically coupled and the clip body 233*b* formed integrally with the elastic piece 233*a* and having a coupling pin 234 protruded therefrom, wherein the coupling pin 234 is fitted into a coupling hole 17*a* formed in the lever 15.

The elastic piece 233*a* has a shape of tongs, such that it is elastically widened outwardly when the rear end of the rod body 231 is inserted thereinto and is restored inwardly when the insertion of the rear end of the rod body 231 is completely completed, thereby being coupled integrally with the rod body 231.

Figure 23:
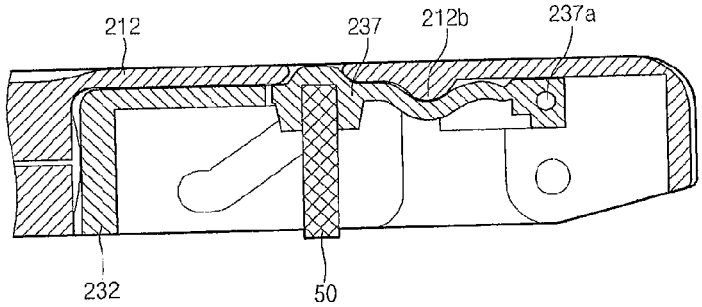
FIG. 23 is a cross-sectional view taken along the line Y-Y of FIG. 15.

The handle head 212 has a shape in which it encloses a rod head 232 to be described below and includes a pressing protrusion 212*b* (See FIG. 23) protruded and formed at a lower surface thereof, wherein the pressing protrusion 212*b* presses a holder 237 of an operating rod 230 to be described below.

Here, a front end of the handle head 212 is coupled to the tilting member 240 by the tilting axis 44, such that the tilting member 240 may be tilted in an upward or downward direction with respect to the handle head 212 based on the tilting axis 44. In addition, the handle head 212 may include a discharge hole 12*a* penetratedly formed in order to discharge foreign materials such as water, or the like, entering the handle 210.

Figure 20:
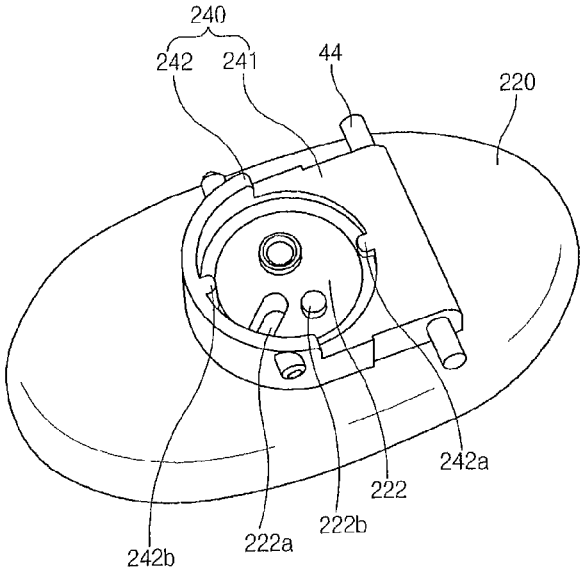
FIG. 20 is a perspective view showing a state in which a shaft of FIG. 19 is inserted into a shaft inserting part.

The shaft 222 is formed vertically to the upper surface of the head part 220 and inserted into a shaft inserting part 242 of a tilting member 240 to be described below, as shown in FIG. 20.

Here, the shaft 222 may also include a bush (not shown) integrally fitted into a circumference thereof so that the shaft 222 is smoothly rotated when the shaft 222 is rotated in the shaft inserting part 242.

Figure 21:
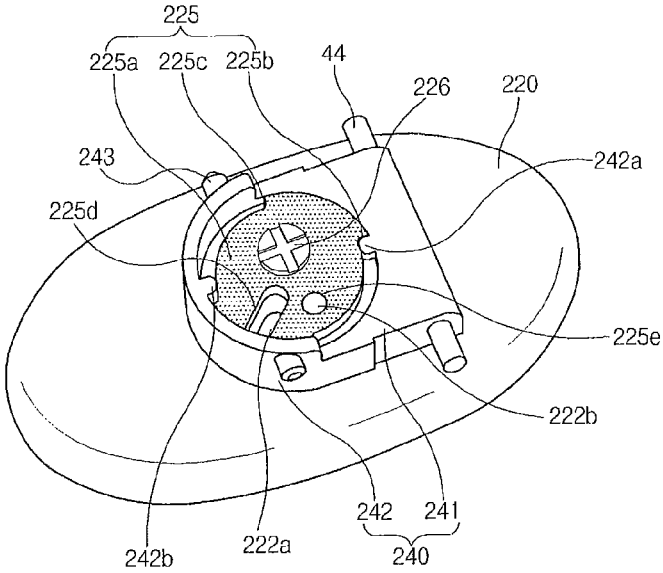
FIG. 21 is a perspective view showing a state in which a stopper member is fixed to an upper surface of the shaft of FIG. 20.
Figure 22:
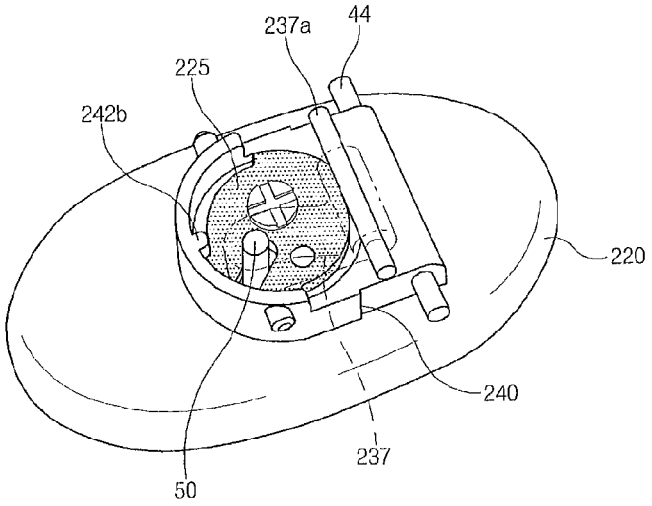
FIG. 22 is a perspective view showing a state in which a rotation driving member coupled to a holder of FIG. 19 is inserted in an inserting hole of the shaft.

As shown in FIG. 21, the stopper member 225 is fixed to an upper surface of the shaft 222 by a bolt 226, such that when the shaft 222 is rotated in the shaft inserting part 242, the stopper member 225 may be rotated together with the shaft 222.

In this case, the shaft 222 and the stopper member 225 is provided with a coupling protrusion 222*b* and a protrusion hole 225*e*, respectively, such that when the stopper member 225 is fixed to the shaft 222 by the bolt 226, the coupling protrusion 222*b* is fitted into the protrusion hole 225*e*, thereby making it possible to prevent the stopper member 225 from being moved on the upper surface of the shaft 222.

Meanwhile, the shaft 222 is provided with an inserting hole 222*a* into which the other end of the rotation driving member 50 is inserted, at a position that is eccentric from the center thereof.

The stopper member 225 limits a rotation angle of the shaft 222 to 0 to 90 degrees to prevent the shaft 222 from being rotated by an angle of 90 degrees or more. The stopper member 225 mainly includes a stopper body 225*a* and first and second stopper parts 225*b* and 225*c* each protruded and formed at position spaced apart from each other on an outer peripheral surface of the stopper body 225*a*.

That is, in the rotating toothbrush 1 according to the first exemplary embodiment of the present invention, the first and second stopper parts 25*b* and 25*c* are formed in the shaft 222 so as to be stepped with respect to the support pin guide surface 25*a*. On the other hand, in the rotating toothbrush 201 according to the second exemplary embodiment of the present invention, the stopper member 225 serving as the first and second stopper part 25*b* and 25*c* is manufactured as a component separate from the shaft 222 and then fixed to the upper surface of the shaft 222.

The stopper body 225*a* is fixed to the shaft 222 by a bolt 226. In addition, a plate surface of the stopper body 225*a* is provided with a protrusion hole 225*e* to which the coupling protrusion 222*b* is coupled and a through-hole 225*d* through which the other end of the rotation driving member 50 penetrates.

The first stopper part 225*b* is locked to a first locking groove 242*a* formed at the shaft inserting part 242 when the head part 220 forms the linear shape with the handle 210 (See FIG. 21), and the second stopper part 225*c* is formed at a position spaced apart from the first stopper part 225*b* and is locked to a second locking protrusion 242*b* formed at the shaft inserting part 242 when the head part 220 form the T shape (See FIG. 27) with the handle 210.

That is, the stopper member 225 is rotated together with the shaft 222 in the range of 0 to 90 degrees between the first and second locking protrusions 242*a* and 242*b*, such that a rotation angle of the head part 220 with respect to the handle 210 may be limited to 0 to 90 degrees.

The operating rod 230 is provided in the handle 210 and operated in conjunction with the lever 15 to move in a length direction of the handle 210. The operating rod 230 includes a rod body 231 connected to the lever 15 to as to be operable in conjunction with the lever 15, the rod head 232 coupled integrally with a front end of the rod body 231 and including tilting guide grooves 235 formed at both sides thereof in order to guide tilting guide protrusions 243, and a holder 237 having one end rotated with respect to a holder axis 237*a* supported in the rod head 232 and the other end which is a free end.

The rod body 231 has the clip 233 fitted into a rear end thereof, wherein the clip 233 is connected to the rear end of the rod body 231 by the coupling pin 234 and the coupling pin 234 is fitted into a coupling hole 17*a* formed in the axis connection piece 17. Therefore, when the lever 15 moves in the front and rear direction based on the lever axis 18, the clip 233 and the operating rod 230 may move linearly in the front and rear direction.

Figure 24:
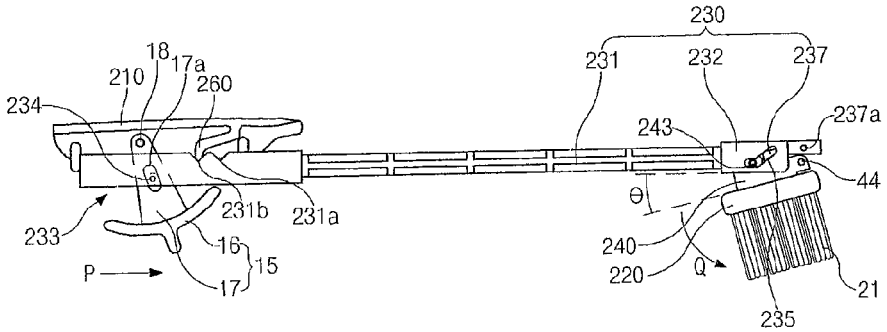
FIG. 24 is a side view showing a state in which a head part is rotated by an angle of 90 degrees while being tilted in an upward in the case in which a lever moves forward in the state of FIG. 17.

Meanwhile, an upper surface of the clip 233 is provided with first and second seating grooves 231*a* and 231*b* in which a movement preventing protrusion 260 formed on an inner surface of the handle 210 is seated, wherein the first and second seating grooves 231*a* and 231*b* are spaced apart from each other. Therefore, when the lever 15 is positioned at an initial position, the movement preventing protrusion 260 is seated in a front first seating groove 231*a*, and when the user moves the lever 15 forward (that is, in a P direction) as shown in FIG. 24, the movement preventing protrusion 260 is seated in a rear second seating groove 231*b*.

That is, in the rotating toothbrush 1 according to the first exemplary embodiment of the present invention, the first and second seating grooves 31*a* and 31*b* are formed in the outer peripheral surface of the rod body 31 and the ball 60 is seated in the first or second seating groove 31*a* or 31*b*. On the other hand, in the rotating toothbrush 201 according to the second exemplary embodiment of the present invention, the movement preventing protrusion 260 instead of the ball 60 and spring 65 of the rotating toothbrush 1 according to the first exemplary embodiment of the present invention is formed on the inner surface of the handle 210 and the first and second seating grooves 231*a* and 231*b* are formed in the clip 233.

Therefore, when the head part 220 forms in the linear shape with the handle 210, the movement preventing protrusion 260 is positioned at the first seating groove 231*a* (See FIG. 17), and when the operating rod 230 linearly moves forward according to the operation of the lever 15 to allow the head part 220 to form the T shape with the handle 210, the movement preventing protrusion 260 is positioned at the second seating groove 231*b* (See FIG. 24), thereby making it possible to prevent movement of the operating rod 230 when the operating rod 230 moves in the front and rear direction.

Figure 25:
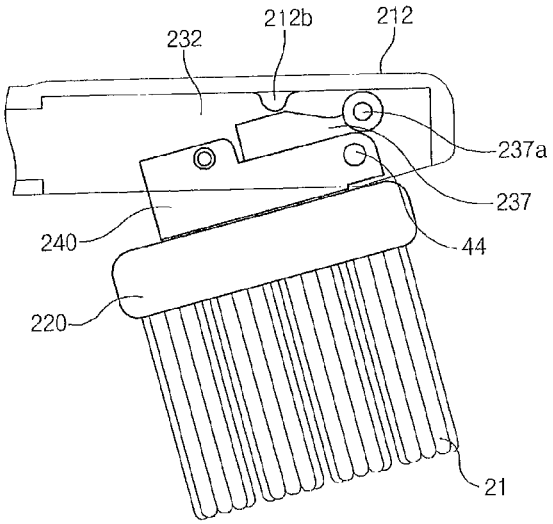
FIG. 25 is a cross-sectional view describing a principle in which a holder is pressed in FIG. 24.
Figure 26:
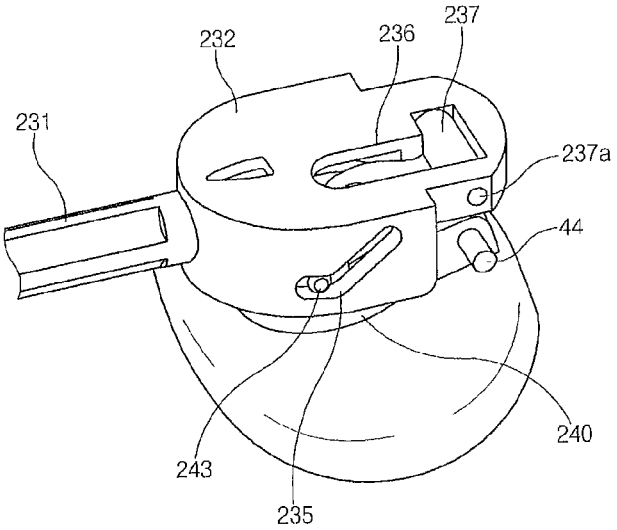
FIG. 26 is a perspective view of FIG. 25 when viewed from the top.

The holder 237 is installed at a cut part 236 formed at the plate surface of the rod head 232 and has one end supported in the cut part 236 so as to be rotatable based on the holder axis 237*a* and the other end that is a free end. Therefore, when the operating rod 230 moves forward, the holder 237 is pressed in the downward direction by the pressing protrusion 212*b* formed at the handle head 212, as shown in FIGS. 25 and 26. At the time, one end of the rotation driving member 50 is fitted into a lower surface of the other end of the holder 237.

That is, in the rotating toothbrush 1 according to the first exemplary embodiment of the present invention, the holder 37 is cut and formed at the plate surface of the rod head 32 to press the pressing protrusion 12*b* by the elastic force of the holder 27 itself. On the other hand, in the rotating toothbrush 201 according to the second exemplary embodiment of the present invention, one end of the holder 237 is connected to the cut part 236 so as to be rotatable based on the holder axis 237*a*.

The tilting member 240 is tilted at a predetermined angle θ (See FIG. 24) in the upward or downward direction based on the tilting axis 44, thereby allowing the head part 220 to be tilted in the upward or downward direction based on the tilting axis 44. Here, the tilting angle θ is approximately 5 to 40 degrees, more preferably, 15 degrees.

Here, the tilting member 240 includes a tilting axis support part 241 supporting the tilting axis 44 inserted thereinto and the shaft inserting part 242 formed integrally with the tilting axis support part 241 and having the shaft 222 inserted thereinto.

The shaft inserting part 242 includes tilting guide protrusions 243 protruded and formed at both sides thereof, wherein the tilting guide protrusions 43 are guided along the tilting guide grooves 235 formed at the rod head 232. Therefore, when the operating rod 230 moves forward, the tilting guide protrusions 243 move along the tilting guide grooves 235, such that the tilting member 240 may be tilted at a predetermined angle θ in the upward direction based on the tilting axis 44.

Figure 27:
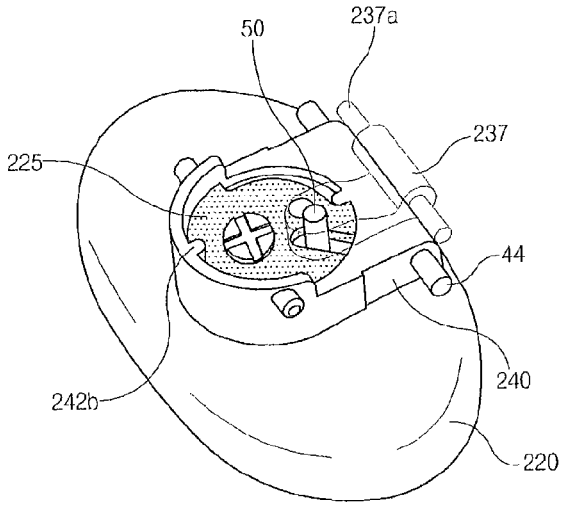
FIG. 27 is a perspective view showing a state in which the shaft is rotated an angle of 90 degrees by a rotation driving member in the case in which the lever moves forward.

The rotation driving member 50 is coupled to the holder 237 and the shaft 222 to rotate the shaft 222 by an angle of about 90 degrees when the operating rod 230 moves forward, such that the head part 220 forms the T shape with the handle 210, as shown in FIG. 27.

A principle in which the shaft 222 is rotated by the rotation driving member 50 as described above is that the rotation driving member 50 is fitted into the inserting hole 222*a* positioned at the position that is eccentric from the center of the shaft 222, such that linear movement of the operating rod 320 may be converted into rotational movement of the shaft 222, similar to the first exemplary embodiment.

Through the above-mentioned configuration, a principle in which the rotating toothbrush 201 according to the exemplary embodiment of the present invention is tilted and rotated will be briefly described with reference to FIGS. 15 to 27.

First, in an initial state, the head part 220 forms the linear shape with the handle 210 as shown in FIGS. 15 to 23.

Then, when the user moves the lever 15 in a P direction (See FIG. 24), the operating rod 230 connected to the lever 15 also moves linearly in the P direction. In this case, the tilting guide protrusion 243 of the tilting member 240 is guided along the tilting guide groove 235 of the rod head 232 to thereby be tilted in the upward direction. At the same time, the rotation driving member 50 moves in the P direction to rotate the shaft 222 by an angle of 90 degrees in a Q direction (See FIG. 24), such that the head part 220 forms the T shape with the handle 210, as shown in FIG. 27. When the operating rod 230 moves linearly in the P direction, the holder 237 is pressed in the downward direction based on the holder axis 237*a* by the pressing protrusion 212*b* formed at the handle head 212, such that the rotation driving member 50 pushes and rotates the shaft 222 in a state in which it descends in the downward direction, corresponding to the tilting of the tilting member 240 (See FIGS. 25 to 27).

Meanwhile, in order to restore this state to the initial state in which the head part 220 forms the linear shape with the handle 210, when the user moves the lever 15 in a direction opposite to the P direction, the operating rod 230 connected to the lever 15 also moves linearly in the direction opposite to the P direction. In this case, the tilting guide protrusion 243 of the tilting member 240 is guided along the tilting guide groove 235 of the rod head 232 to thereby be tilted in the downward direction. At the same time, the rotation driving member 50 moves in the direction opposite to the P direction to rotate the shaft 222 by an angle of 90 degrees in a direction opposite to the Q direction, such that the head part 220 forms the linear shape with the handle 210. When the operating rod 230 moves linearly in the direction opposite to the P direction, the holder 237 is separated from the pressing protrusion 212*b* formed at the handle head 212 to thereby be restored to its original position, such that the rotation driving member 50 pushes and rotates the shaft 222 in a state in which it ascends in the upward direction, corresponding to the tilting of the tilting member 240 in the downward direction.

With the rotating toothbrush 201 according to the second exemplary embodiment of the present invention having the above-mentioned configuration, when the lever 15 moves forward, since the head part 220 is tilted at a predetermined angle θ in the upward direction and at the same time, forms the T shape with the handle 210, the bristles 21 may reach the lower portions of the lower front teeth T, as shown in FIG. 13. Therefore, generation of tartar is prevented as much as possible, thereby making it possible to reduce a time required for brushing teeth.

In addition, since the rotating toothbrush 1 has a structure in which rotation states of the head part 220 and the handle 210 may be freely adjusted by moving the lever 15 forward or backward (that is, a structure in which the head part 220 may form the linear shape or the T shape with the handle 210), it is rotated so that the head part 220 form the linear shape with the handle 210 when back teeth are brushed and forms the T shape with the handle 210 when front teeth or canine teeth are brushed, such that it may be conveniently used.

Third Exemplary Embodiment

A rotating toothbrush according to a second exemplary embodiment of the present invention has a structure in which a head part form a T shape with a handle simultaneously with being tilted at a predetermined angle (θ) in an upward direction to allow bristles to reach lower portions of lower front teeth, similar to the rotating toothbrush according to the first and second exemplary embodiments of the present invention.

Figure 28:
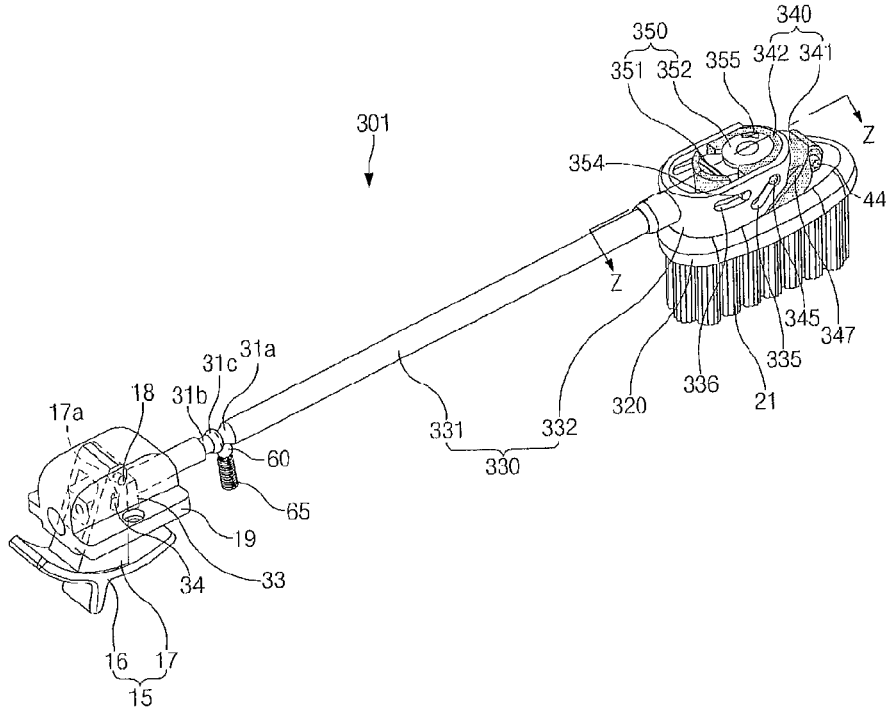
FIG. 28 is a perspective view showing a state in which a handle is removed in a rotating toothbrush according to a third exemplary embodiment of the present invention.
Figure 29:
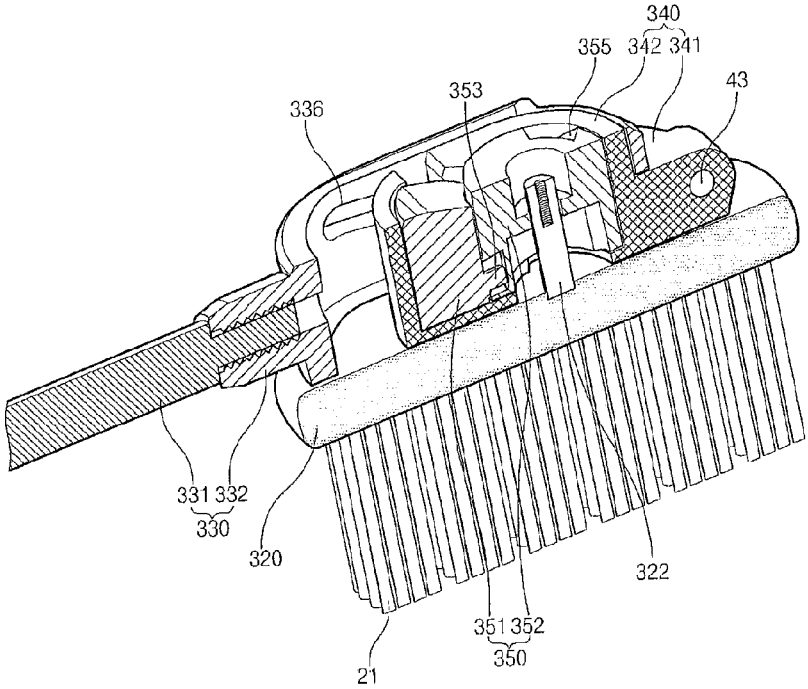
FIG. 29 is a cross-sectional view taken along the line Z-Z of FIG. 28.
Figure 30:
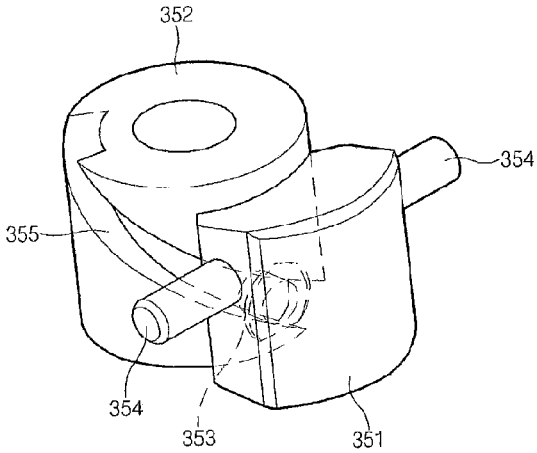
FIG. 30 is a perspective view showing an initial state of a rotation driving member of FIG. 28.

The rotating toothbrush 301 according to the third exemplary embodiment of the present invention is mainly configured to include a handle 10 (See FIG. 2) provided with a lever 15, a head part 320 having bristles 21 implanted on a lower surface thereof and a shaft 322 vertically provided on an upper surface thereof, a tilting member 340 tilted in an upward direction based on a tilting axis 44 by an operating rod 330 operated in conjunction with the lever 15, and a rotation driving member 350 rotating the shaft 322 when the operating rod 330 moves forward, thereby allowing the head part 320 to form a T shape with the handle 10, as shown in FIGS. 28 to 30.

Figure 4:
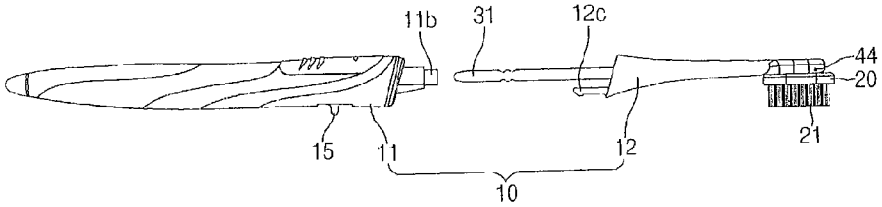
FIG. 4 is an exploded perspective view showing a state in which a handle body and a handle head are separated from each other in FIG. 3.

In the handle 10, which is to be grasped by a user, a handle body 11 and a handle head 12 are detachably assemble to each other, as shown in FIG. 4. To this end, an inner side of a rear end of the handle head 12 is provided with a hook 12*c* protruded toward the handle body 11 and hooked to an inner side of the handle body 11. Here, the handle body 11 and the handle head 12 are assembled to each other in a hook scheme. However, the handle body 211 and the handle head 212 may also be manufactured so as to be assembled to each other in a screw scheme.

The handle body 11 includes the lever 15 installed so as to be rotatable in a front and rear direction based on a lever axis 18.

The lever 15 includes a lever body 16 exposed outwardly of the handle body 11 and an axis connection piece 17 extended from the lever body 16 and connected to the lever axis 18.

Here, an inner portion the handle body 11 is provided with a fixing bracket 19 and a ball 60 and a spring 65, wherein the fixing bracket 19 is fixed to the inner portion of the handle body 11 and connected to the axis connection piece 17 by the lever axis 18, and the ball 60 and the spring 65 elastically support the operating rod 30 against the handle body 11.

The ball 60 contacts an outer peripheral surface of the operating rod 330, and the spring 65 serves to support the ball 60 so as to be elastically pressed toward the operating rod 330. That is, the ball 60 applies a predetermined force to the operating rod 330 by elastic force of the spring 65, thereby making it possible to prevent movement of the operating rod 330 when the operating rod 330 moves linearly in the handle 10.

A front end of the handle head 12 is coupled to the tilting member 340 by the tilting axis 44, such that the tilting member 340 may be tilted in an upward or downward direction with respect to the handle head 12 based on the tilting axis 44. In addition, the handle head 12 may include a discharge hole 12*a* (See FIG. 3) penetratedly formed in order to discharge foreign materials such as water, or the like, entering the handle 10.

The shaft 322 is provided vertically to the upper surface of the head part 320, is inserted into a rotating body 352 to be described below, and is then coupled to a bolt (not shown) penetrating through the handle head 12, such that it is coupled with the rotating body 352.

The operating rod 330 is provided in the handle 10 and operated in conjunction with the lever 15 to move in a length direction of the handle 10. The operating rod 330 includes a rod body 331 connected to the lever 15 so as to be in conjunction with the lever 15 and a rod head 332 coupled integrally with a front end of the rod body 331 and having a shape in which it encloses a receiving body 342 to be described below.

The rod body 331 has a sleeve 33 fitted into a rear end thereof, wherein the sleeve 33 includes coupling pins protruded and formed at both side thereof and the coupling pin 34 is fitted into a coupling hole 17*a* formed in the axis connection piece 17. Therefore, when the lever 15 moves in the front and rear direction based on the lever axis 18, the sleeve 33 and the operating rod 30 may move linearly in the front and rear direction.

Figure 31:
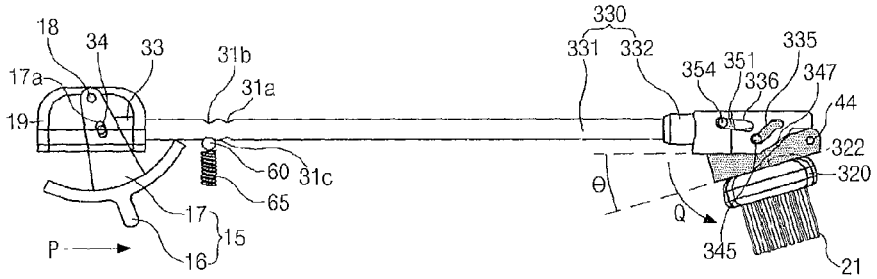
FIG. 31 is a side view showing a state in which a head part is rotated by an angle of 90 degrees while being tilted in an upward direction in the case in which a lever moves forward in the state of FIG. 28.

Meanwhile, the rod body 331 includes first and second seating grooves 31*a* and 31*b* depressed at a depth smaller than an outer diameter of the rod body 331 in an outer peripheral surface thereof so as to seat the ball 60. In this case, the first and second seating grooves 31*a* and 31*b* are formed at two positions, respectively, having a pressing protrusion 31*c* therebetween. Therefore, when the lever 15 is positioned at an initial position as shown in FIG. 28, the ball 60 contacts the front first seating groove 31*a*. Then, when the user moves the lever 15 forward as shown in FIG. 31, the ball 60 is pushed toward the spring 65 by the pressing protrusion 31*c* (in this case, the spring 65 is compressed). Thereafter, when the pressing protrusion 31*c* passes through the ball 60, the ball 60 contacts the rear second seating groove 31*b* while the spring 65 is restored.

The rod head 332 is manufactured separately from the rod body 331 and is coupled to the front end of the rod body 331 in a screw scheme. The rod head 332 has an empty inner portion so that a receiving body 342 to be described below is enclosed and includes tilting guide grooves 335 and slots 336 formed at both sides thereof, respectively.

Here, the tilting guide groove 335 needs to have a shape in which it does not interfere with a tilting guide protrusion 345 to be described below when the tilting member 340 is tilted based on the titling axis 44, and the slot 336 needs to have a shape in which it does not interfere with a support protrusion to be described below.

The tilting member 340 is tilted at a predetermined angle θ (See FIG. 31) in the upward or downward direction based on the tilting axis 44, thereby allowing the head part 320 to be tilted in the upward or downward direction based on the tilting axis 44. Here, the tilting angle θ is approximately 5 to 40 degrees, more preferably, 15 degrees.

The tilting member 340 includes a tilting body 341 having tilting inclined surfaces 347 formed at both sides thereof and the receiving body 342 formed integrally with the tilting body 341 and receiving the rotation driving member 350 therein.

The tilting body 341, which is a member tilted in the upper or downward direction based on the tilting axis, includes the tilting inclined surfaces 347 inclinedly formed at both sides thereof and a tilting axis inserting hole 43 penetratedly formed at a front end thereof, wherein the tilting inclined surfaces 347 are pressed by the rod head 332 and the tilting axis inserting hole 43 has the tilting axis 44 inserted thereinto.

Figure 32:
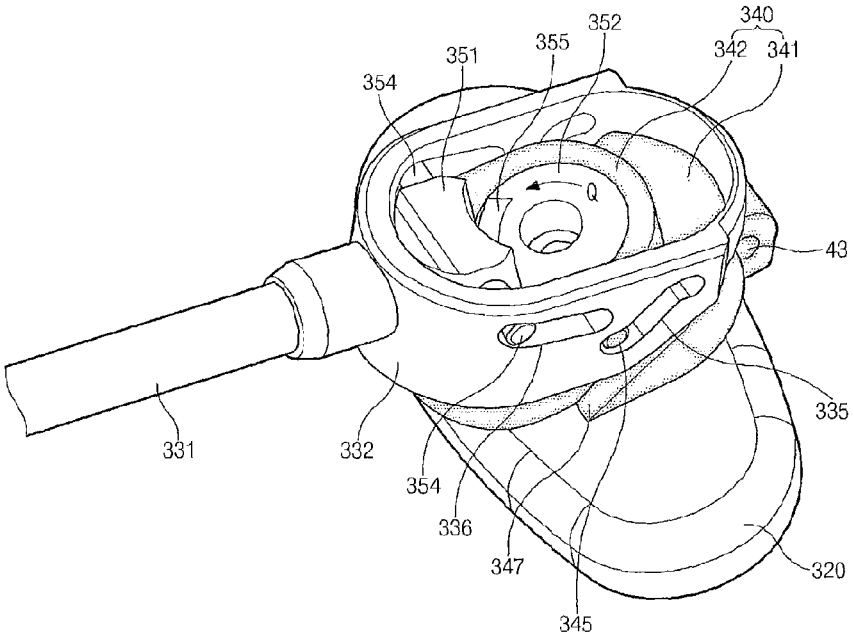
FIG. 32 is a perspective view of FIG. 31 when viewed from the top.
Figure 33:
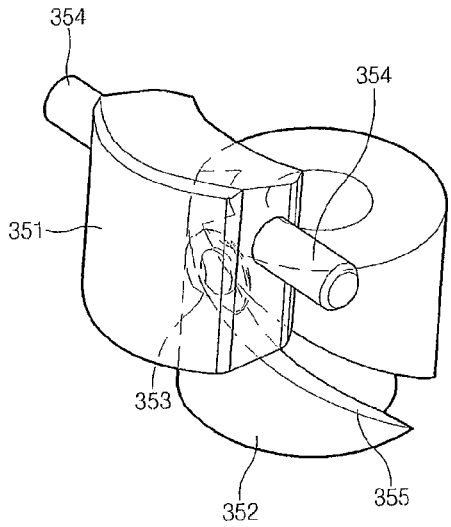
FIG. 33 is a perspective view showing a rotation driving member in a state of FIG. 32.

The tilting inclined surface 347 is a surface pressed by the operating rod 330 when the operating rod 330 moves forward, thereby allowing the tilting member 340 to be tilted. That is, when the operating rod 330 moves forward as shown in FIG. 32, the rod head 332 of the operating rod 330 moves forward along the tilting inclined surfaces 347, such that the tilting member 340 may be tilted in the upward direction. In this case, lower surfaces of both sides of the rod head 332 need to be provided with inclined surfaces so as not to interfere with the tilting inclined surfaces 347.

The receiving body 342 has an empty inner portion with a size enough to receive the rotation driving member 350 therein and includes the tilting guide protrusions 345 protruded and formed at both sides thereof, wherein the tilting guide protrusions 345 are guided along the tilting guide grooves 335 formed in the operating rod 330. Therefore, when the tilting member 340 is tilted based on the tilting axis 44, the tilting guide protrusions 345 may move along the tilting guide grooves 335 formed so as to correspond to a trajectory of the tilting member 340.

The rotation driving member 350 rotates the shaft 332 when the tilting member 340 is tilted, thereby allowing the head part 320 to form the T shape with the handle 10.

The rotation driving member 350 is installed in the receiving body 342 and includes a rotation guide body 351 provided with a rotation guide protrusion 353 and a rotating body 352 provided with an inclined cam 355 guided along the rotation guide protrusion 353, as shown in FIG. 30.

That is, in the rotating toothbrushes 1 and 201 according to the first and second exemplary embodiments of the present invention, the rotation driving member 50 is configured to be eccentrically inserted into the shaft 22 or 222. On the other hand, in the rotating toothbrush 301 according to the third exemplary embodiment of the present invention, the rotation driving member 350 is configured of the rotation guide body 351 and the rotating body 352.

The rotation guide body 351 includes the rotation guide protrusion 353 formed so as to be protruded toward the rotating body 352 and the support protrusions 354 formed at both sides thereof so as to be protruded toward the rod head 332.

Here, the rotation guide protrusion 353 is fitted into the inclined cap 355 and is guided by the rotation guide protrusion 353, such that the shaft 322 may be rotated together with the rotating body 352.

The support protrusion 354 is guided along the slot 336 formed in the rod head 332 when the operating rod 330 linearly moves forward or backward.

The rotating body 352 is coupled integrally with the shaft 332 and includes the inclined cap 355 formed in an outer peripheral surface thereof, wherein the inclined cap 355 has a shape in which it is inclined in a spiral direction. Here, the inclined cam 355 has a length corresponding to a rotation angle (0 to 90 degrees) of the rotating body 352, such that a rotation angle of the head part 320 with respect to the handle 10 may be limited to 0 to 90 degrees.

Through the above-mentioned configuration, a principle in which the rotating toothbrush 301 according to the exemplary embodiment of the present invention is tilted and rotated will be briefly described with reference to FIGS. 28 to 33.

First, in an initial state, the head part 320 forms the linear shape with the handle 10 as shown in FIGS. 28 to 30.

Then, when the user moves the lever 15 in a P direction (See FIG. 31), the operating rod 330 connected to the lever 15 also moves linearly in the P direction. Therefore, the rod head 332 presses the tilting inclined surface 347, such that the tilting member 340 is gradually tilted in the upward direction based on the tilting axis 44. At the same time, the rotation guide protrusion 353 is guided along the inclined cam 355, such that the rotating body 352 is rotated by an angle of 90 degrees in a Q direction (See FIGS. 32 and 33) to rotate the shaft 322, thereby allowing the head part 20 to form the T shape with the handle 10.

Meanwhile, in order to restore this state to the initial state in which the head part 320 forms the linear shape with the handle 10, when the user moves the lever 15 in a direction opposite to the P direction, the operating rod 330 connected to the lever 15 also moves linearly in the direction opposite to the P direction. In this case, the tilting member 340 is guided along the tilting inclined surface 347 to thereby be tilted in the upward direction and at the same time, the rotating body 352 and the shaft 22 are simultaneously rotated by an angle of 90 degrees in a direction opposite to the Q direction, thereby allowing the head part 320 to form the linear shape with the handle 10.

With the rotating toothbrush 301 according to the third exemplary embodiment of the present invention having the above-mentioned configuration, when the lever 15 moves forward, since the head part 320 is tilted at a predetermined angle θ in the upward direction and at the same time, forms the T shape with the handle 10, the bristles 21 may reach the lower portions of the lower front teeth T, as shown in FIG. 13. Therefore, generation of tartar is prevented as much as possible, thereby making it possible to reduce a time required for brushing teeth.

In addition, since the rotating toothbrush 1 has a structure in which rotation states of the head part 320 and the handle 10 may be freely adjusted by moving the lever 15 forward or backward (that is, a structure in which the head part 320 may form the linear shape or the T shape with the handle 10), it is rotated so that the head part 320 form the linear shape with the handle 10 when back teeth are brushed and forms the T shape with the handle 10 when front teeth or canine teeth are brushed, such that it may be conveniently used.

In the rotating toothbrush 301 according to the third exemplary embodiment of the present invention described above, the sleeve operated in conjunction with the lever is installed at the rear end of the operating rod. However, the sleeve may be replaced by the clip configured of the elastic piece and the clip body as in the rotating toothbrush 201 according to the second exemplary embodiment of the present invention.

Further, in the rotating toothbrush 301 according to the third exemplary embodiment of the present invention described above, in order to prevent the movement of the operating rod, the first and second seating grooves are formed in the outer peripheral surfaces of the rod body and the ball is seated in the first or second seating groove. However, the first and second seating grooves may be formed in the clip and the movement preventing protrusion may be formed in the inner surface of the handle as in the rotating toothbrush 201 according to the second exemplary embodiment of the present invention.

It will be obvious to those skilled in the art that the present invention is not limited to the above-mentioned exemplary embodiments, but may be variously modified without departing from the spirit and scope of the present invention. Therefore, various these modifications should be understood to fill within the scope of the present invention.

The invention claimed is:

1. A rotating toothbrush comprising:

a handle provided with a lever;

a head part having bristles implanted on a lower surface thereof and a shaft vertically provided on an upper surface thereof;

an operating rod provided in the handle and operated in conjunction with the lever to move linearly in a length direction of the handle;

a tilting member rotatably supporting the shaft and pressed when the operating rod moves forward, thereby being tilted at a predetermined angle in an upward direction together with the head part based on a tilting axis; and a rotation driving member connected to the operating rod and the shaft to rotate the shaft when the operating rod moves forward, thereby allowing the head part to form a T shape with the handle, wherein the rotation driving member has one end fixed to a lower surface of the operating rod and the other end inserted into the shaft so as to be eccentric from the center of the shaft, and wherein the operating rod includes:

a rod body connected integrally with the lever;

a rod head coupled integrally with a front end of the rod body and including tilting guide grooves formed at both sides thereof; and a holder having one end connected to the rod head and the other end which is a free end to fix one end of the rotation driving member, the holder being pressed by a pressing protrusion formed at the handle when the operating rod moves forward, thereby being pressed in a downward direction.

2. The rotating toothbrush according to claim 1, wherein the handle includes a handle body provided with the lever and a handle head having one side assembled integrally with the handle body and the other side assembled to the tilting member through the tilting axis and having a discharge hole formed in an upper surface thereof, the handle head having the pressing protrusion formed at a lower surface thereof.

3. The rotating toothbrush according to claim 2, wherein the holder is cut and formed at the rod head.

4. The rotating toothbrush according to claim 2, wherein the holder is installed at a cut part cut and formed in the rod head and has one end rotatably supported in the cut part through a holder axis.

5. The rotating toothbrush according to claim 1, wherein the rotation driving member includes:

a rotation guide body provided in the tilting member so as to be connected to the operating rod and provided with a rotation guide protrusion; and a rotating body provided in the tilting member and having an inclined cam formed in an outer peripheral surface thereof and guided along the rotation guide protrusion to thereby be rotated when the tilting member is tilted, thereby rotating the shaft.

6. The rotating toothbrush according to claim 5, wherein the tilting member includes:

a tilting body supporting the tilting axis and having tilting inclined surfaces formed at both sides thereof, the tilting inclined surfaces being pressed by the operating rod when the operating rod moves forward, thereby allowing the tilting member to be tilted; and a receiving body having tilting guide protrusions formed at both sides thereof and receiving the rotation driving member therein, the tilting guide protrusions being guided along tilting guide grooves formed in the operating rod.

7. The rotating toothbrush according to claim 6, wherein the rotation guide body includes support protrusions formed at both sides thereof so as to be protruded toward the operating rod, and the operating rod is provided with slots for guiding the support protrusions when it moves in a front and rear direction.

8. The rotating toothbrush according to claim 7, wherein the operating rod includes:

a rod body connected integrally with the lever; and a rod head coupled integrally with a front end of the rod body and including the tilting guide grooves and the slots penetratedly formed at both sides thereof, respectively, and enclosing the receiving body.

9. The rotating toothbrush according to claim 5, wherein the handle includes:

a handle body provided with the lever; and a handle head having one side assembled integrally with the handle body and the other side assembled to the tilting member through the tilting axis and having a discharge hole formed in an upper surface thereof.

10. The rotating toothbrush according to claim 1, wherein the operating rod has a sleeve fitted into a rear end thereof, the sleeve having a coupling pin formed to be protruded therefrom and fitted into a coupling hole formed in the lever.

11. The rotating toothbrush according to claim 1, wherein a rear end of the operating rod is provided with a clip having an elastic piece to which the rear end of the operating rod is elastically coupled and a clip body formed integrally with the elastic piece and having a coupling pin protruded therefrom, the coupling pin being fitted into a coupling hole formed in the lever.

12. The rotating toothbrush according to claim 11, wherein the clip includes first and second seating grooves formed in an upper surface thereof so as to be spaced apart from each other and seat a movement preventing protrusion formed at an inner surface of the handle, such that when the head part forms the linear shape with the handle, the movement preventing protrusion is positioned at the first seat groove, and when the operating rod moves forward to allow the head part to form the T shape with the handle, the movement preventing protrusion is positioned at the second seating groove.

13. The rotating toothbrush according to claim 1, wherein the head part is tilted at an angle of 5 to 40 degrees in the upward direction with respect to the handle based on the tilting axis.

14. The rotating toothbrush according to claim 1, wherein the head part is rotated by an angle of 0 to 90 degrees with respect to the handle based on the shaft.

15. The rotating toothbrush according to claim 1, wherein the lever is rotated in a front and rear direction based on the lever axis installed at an inner portion of the handle.

16. A rotating toothbrush comprising:

a handle provided with a lever;

a head part having bristles implanted on a lower surface thereof and a shaft vertically provided on an upper surface thereof;

an operating rod provided in the handle and operated in conjunction with the lever to move linearly in a length direction of the handle;

a tilting member rotatably supporting the shaft and pressed when the operating rod moves forward, thereby being tilted at a predetermined angle in an upward direction together with the head part based on a tilting axis; and a rotation driving member connected to the operating rod and the shaft to rotate the shaft when the operating rod moves forward, thereby allowing the head part to form a T shape with the handle, wherein the rotation driving member has one end fixed to a lower surface of the operating rod and the other end inserted into the shaft so as to be eccentric from the center of the shaft, and wherein the tilting member includes:

a tilting axis support part supporting the tilting axis; and a shaft inserting part formed integrally with the tilting axis support part, having the shaft inserted thereinto, and having tilting guide protrusions formed at both sides thereof.

17. The rotating toothbrush according to claim 16, wherein the shaft is supported by a support pin in the shaft inserting part, and the shaft has a support pin guide surface formed in a rotation direction so that it does not interfere with the support pin when it is rotated.

18. The rotating toothbrush according to claim 17, wherein the shaft is provided with a first stopper part to which the support pin is locked when the head part forms a linear shape with the handle and a second stopper part to which the support pin is locked when the head part form the T shape with the handle, the first stopper part and the second stopper part being formed to be stepped with respect to the support pin guide surface.

19. The rotating toothbrush according to claim 16, further comprising a stopper member fixed integrally with an upper surface of the shaft to prevent the shaft from being rotated by a predetermined angle or more with respect to the tilting member.

20. The rotating toothbrush according to claim 19, wherein the stopper member includes:

a stopper body;

a first stopper part protruded and formed on an outer peripheral surface of the stopper body and locked to a first locking groove formed at the shaft inserting part when the head part form a linear shape with the handle; and a second stopper part protruded and formed at a position spaced apart from the first stopper part on the outer peripheral surface of the stopper body and locked to a second locking protrusion formed at the shaft inserting part when the head part form the T shape with the handle.

21. A rotating toothbrush comprising:

a handle provided with a lever;

a head part having bristles implanted on a lower surface thereof and a shaft vertically provided on an upper surface thereof;

an operating rod provided in the handle and operated in conjunction with the lever to move linearly in a length direction of the handle;

a tilting member rotatably supporting the shaft and pressed when the operating rod moves forward, thereby being tilted at a predetermined angle in an upward direction together with the head part based on a tilting axis; and a rotation driving member connected to the operating rod and the shaft to rotate the shaft when the operating rod moves forward, thereby allowing the head part to form a T shape with the handle, wherein the operating rod has a sleeve fitted into a rear end thereof, the sleeve having a coupling pin formed to be protruded therefrom and fitted into a coupling hole formed in the lever, and wherein the handle further includes a ball and a spring installed at an inner portion thereof, the ball contacting an outer peripheral surface of the operating rod and the spring elastically pressing the ball toward the operating rod.

22. The rotating toothbrush according to claim 21, wherein the operating rod includes first and second seating grooves formed in an outer peripheral surface thereof so as to be spaced apart from each other and seat the ball, such that when the head part forms the linear shape with the handle, the ball is positioned at the first seat groove, and when the operating rod moves forward to allow the head part to form the T shape with the handle, the ball is positioned at the second seating groove.

* * * * *